US007438549B2

(12) United States Patent
Weckerle

(10) Patent No.: US 7,438,549 B2
(45) Date of Patent: Oct. 21, 2008

(54) COMPOUND STORAGE UNIT FOR A MOLDING PROCESS

(75) Inventor: Thomas Weckerle, Peissenberg (DE)

(73) Assignee: Weckerle GmbH, Weilheim (DE)

( * ) Notice: Subject to any disclaimer, the term of this patent is extended or adjusted under 35 U.S.C. 154(b) by 0 days.

(21) Appl. No.: 11/632,820

(22) PCT Filed: Jul. 13, 2005

(86) PCT No.: PCT/EP2005/007620

§ 371 (c)(1),
(2), (4) Date: Jan. 18, 2007

(87) PCT Pub. No.: WO2006/010481

PCT Pub. Date: Feb. 2, 2006

(65) Prior Publication Data

US 2007/0298138 A1 Dec. 27, 2007

(30) Foreign Application Priority Data

Jul. 22, 2004 (DE) ..... 10 2004 035 439

(51) Int. Cl.
*B29C 31/04* (2006.01)

(52) U.S. Cl. ..... 425/185; 425/192 R; 425/449

(58) Field of Classification Search ..... 425/DIG. 32, 425/449, 256, 182, 185, 186, 190, 192 R, 425/195; 366/92; 222/168
See application file for complete search history.

(56) References Cited

U.S. PATENT DOCUMENTS 2,263,302 A * 11/1941 Johnson ..... 425/507
5,780,018 A * 7/1998 Collins et al. ..... 424/64
6,273,215 B1 * 8/2001 Horan et al. ..... 187/203
6,962,271 B2 * 11/2005 Gregson, Jr. ..... 222/166

* cited by examiner

*Primary Examiner*—Robert B Davis
(74) *Attorney, Agent, or Firm*—Howard & Howard Attorneys, P.C.

(57) ABSTRACT

The invention relates to a compound storage unit (1) for a molding process, in particular for producing lipsticks comprising a container (2) for moldable compounds, wherein said container consists of a housing (3), a heating device (4) which heats the moldable compounds and disposed in the housing (3) of the container (2), a mixing device (5) for mixing the heated compounds in the container (2), a dispenser device (6) for extracting the compounds from the container (2), a fixing device (7) for removably fixing the container (2)to a molding device (20) for molding the compounds and a corresponding molding device 20) for molding compounds by means of a mould, a corresponding molding system and a transport carriage (30). The aim of the invention is to develop a storage unit and a molding device which make it possible to substantially reduce the standstill time of the molding device for exchanging the moldable compound.

13 Claims, 3 Drawing Sheets

COMPOUND STORAGE UNIT FOR A MOLDING PROCESS

Figure 1:
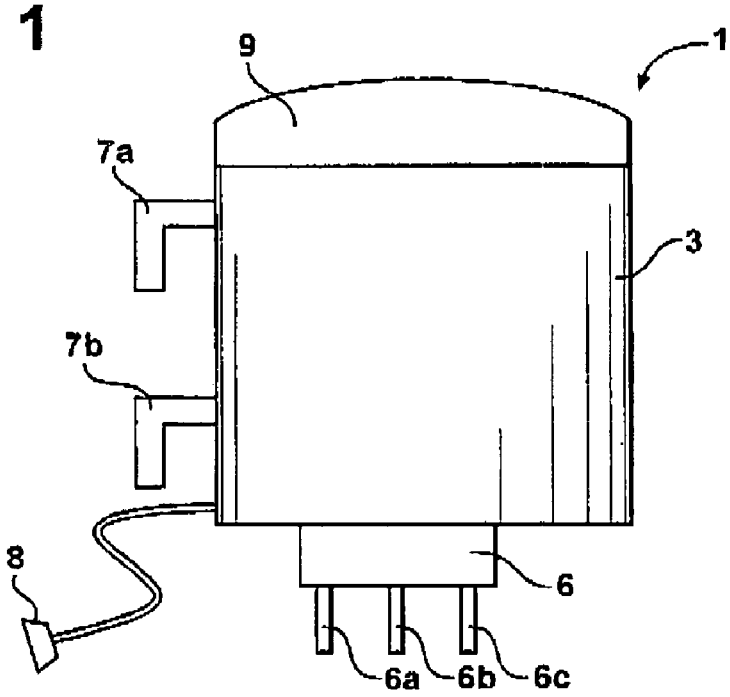

The present invention relates to a storing unit for materials in a molding process, in particular for producing lipstick leads, as well as a corresponding molding apparatus.

A molding apparatus for molding materials, for example lipstick leads, removes the materials to be molded out of a molding unit in a hot and liquid condition. The molding unit comprises for that a heating means and a mixing means in order to heat-up the materials to be molded which are delivered as firm block and thereby make the materials liquid. The liquid materials are then transported via tubes to a filling unit for filling the molds.

With the molding apparatus known in the art, the exchange of materials, for example of the color of the materials, is very time consuming and the exchange leads therefore to long shutdown times of the molding apparatus. If the materials should be exchanged, in a first step the storing unit, the tubes connected to the storing unit and the filling unit must be cleaned. After that in a second step, the materials delivered as a block must be filled into the storing unit and must be heated-up there by means of the heating means and the mixing means and the materials are thereby made liquid. Only after that the molding apparatus can be used again.

The object of the present invention is therefore to provide a storing unit and a molding apparatus with which the shutdown time of the molding apparatus during the exchange of the materials to be molded is substantially reduced.

According to the invention this object is solved by a storing unit for materials in a molding process, in particular for producing lipstick leads, wherein the storing unit comprises the following features:

- a container for keeping the materials to be molded, wherein the container comprises a housing,
- heating means for heating-up the materials to be molded, wherein the heating means is located in the housing of the container,
- mixing means for mixing the heated-up materials in the container,
- dispensing means for removing the heated-up materials from the container and
- attaching means for removable attaching the container to a molding apparatus for molding materials.

By means of the storing unit according to the invention, it is possible to substantially reduce the shutdown time of a molding apparatus during the exchange of the materials to be molded. Since the storing unit according to the invention is removable attached to the molding apparatus, new materials to be molded can be heated-up and thereby made liquid while the molding apparatus receives old materials from a storing unit in an additional storing unit. For that the molding unit uses the heating means and the mixing means located in the storing unit. As soon as the molding process with the old materials is finished, the molding unit according to the invention can be removed from the molding apparatus by means of the attaching means for removable attaching the container to the molding apparatus and the storing unit with the already liquid new materials to be molded can be attached to the molding apparatus.

Since the dispensing means is located at the storing unit, the dispensing means is also exchanged when the storing unit is exchanged. This enables that the new materials to be molded may be directly, this means without cleaning the tubes and the dispensing means as it is necessary in the prior art, after the exchange of the storing unit, filled in the molds of the molding apparatus.

In a preferred embodiment of the present invention the storing unit according to the present invention comprises a contact via which at least the heating means or the mixing means can be provided with power. In a further preferred embodiment both means are provided with power via this contact. Alternatively each means can comprise its own contact. By means of this contact the exchange of the storing units is further simplified. In addition this contact enables that the storing unit can also be easily provided with power if the storing unit is located at a place remote from the molding apparatus. This can be used, for example, to directly prepare the new materials in a storing unit for the molding apparatus in a laboratory, while the molding apparatus still receives other materials from a different storing unit. As part of this preparation the heating means and the mixing means of the storing unit can be used for heating-up and mixing the new materials. Further units, for example load cells and soaking means in the storing unit, can support the preparation of the materials in the storing unit.

The contacts for providing with power can also be advantageously during the transport of the storing unit. If the storing unit has to cover a long distance from the laboratory to the molding apparatus, the contact or the contacts can be used to provide the heating means and/or the mixing means during the transport with power. By this it can be assured that the materials to be molded have the necessary condition when they arrive at the molding apparatus.

In a further preferred embodiment the container comprises a lid in order to keep the heat loss as small as possible, for example during the transport of the storing unit or during the use of the storing unit at a molding apparatus.

According to the invention the object is also solved by a molding apparatus for molding materials using a mold, in particular for molding lipstick leads. The molding apparatus comprises attaching means for removable attaching the storing unit according to the invention. By using such a molding apparatus with such an attaching means the shutdown time of the molding apparatus during the exchange of the materials to be molded can be substantially reduced, since with the exchange of the materials to be molded at the same time the complete storing unit including heating means, mixing means and dispensing means is exchanged. The cleaning of these means can therefore be carried out at a different point in time. In addition by using the molding apparatus according to the invention the heating-up and making liquid of the materials to be molded can be carried out already in parallel to the preceding molding process in the storing unit.

Preferably the molding apparatus comprises also at least one contact which can be brought into contact with a contact of the storing unit in order to provide the storing unit with power. By providing such a contact the duration of the exchange of the storing units can further be substantially reduced.

In a preferred embodiment of the molding apparatus according to the present invention, the attaching means of the molding apparatus is adjustable with respect to the height by means of a transport means. By this the exchange process of the storing unit can be substantially simplified.

For exchanging the storing unit, the storing unit can be driven downwards by means of the transport means and, for example, placed on a carriage. On this carriage the attaching means can be easily released and thereby the storing unit can be removed from the molding apparatus. The storing unit can then be transported away on the carriage to be cleaned. A different carriage with a further storing unit can then be placed at the molding apparatus in such a way that the attaching means of the storing unit can easily be attached to the attaching means of the molding apparatus. After this the storing unit can be transported into the height which is necessary for the operation of the molding apparatus by means of the transporting means.

In a further preferred embodiment the molding apparatus comprises at least two attaching means each for removable attaching one storing unit. Preferably each of these at least two attaching means comprises at least one contact via which the corresponding storing unit can be provided with power.

In a further preferred embodiment the at least two attaching means can exchange their position in such a manner that the removable attached storing means attached to the attaching means each are located either in a working position or in a waiting position. The storing unit in the working position can then for example be placed in such a manner that the corresponding dispending means dispenses the heated-up materials for the molding process. The other storing unit can be, for example, either a storing unit which can be exchanged for cleaning and filling up again or as storing unit in which already new materials for filling by the molding apparatus are ready.

According to the invention the object is also solved by a molding system with a molding apparatus for molding materials using a mold and a storing unit for storing the materials for a molding process, wherein the molding apparatus comprises attaching means for removable attaching a storing unit and the storing unit comprises a container for keeping the materials to be molded, wherein the container comprises a housing, heating means for heating-up the materials to be molded, wherein the heating means is located in the housing of the container, mixing means for mixing the heated-up materials in the container, dispensing means for removing the heated-up materials from the container and attaching means for removable attaching the container to a molding apparatus for molding materials.

The invention relates also to a transport carriage for transporting the above described storing unit, wherein the transport carriage comprises at least one attaching means for removable attaching at least one storing unit. Preferably the transport carriage comprises also a contact via which the storing unit can be provided with power. In a further preferred embodiment, the transport carriage comprises also a holding for the dispensing means.

Figure 2:
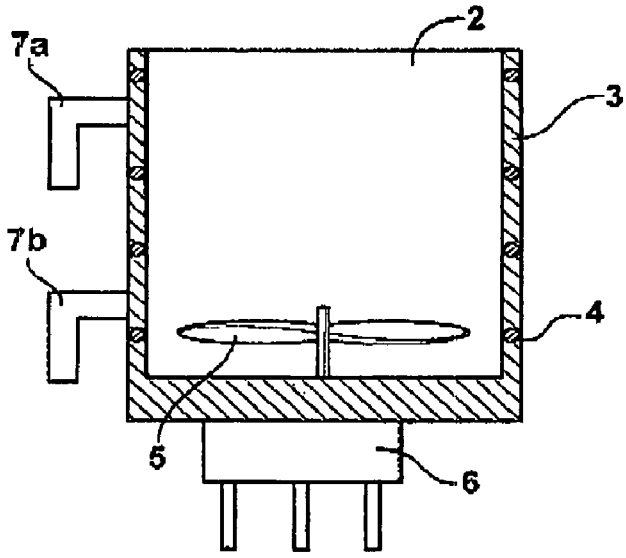
Figure 3:
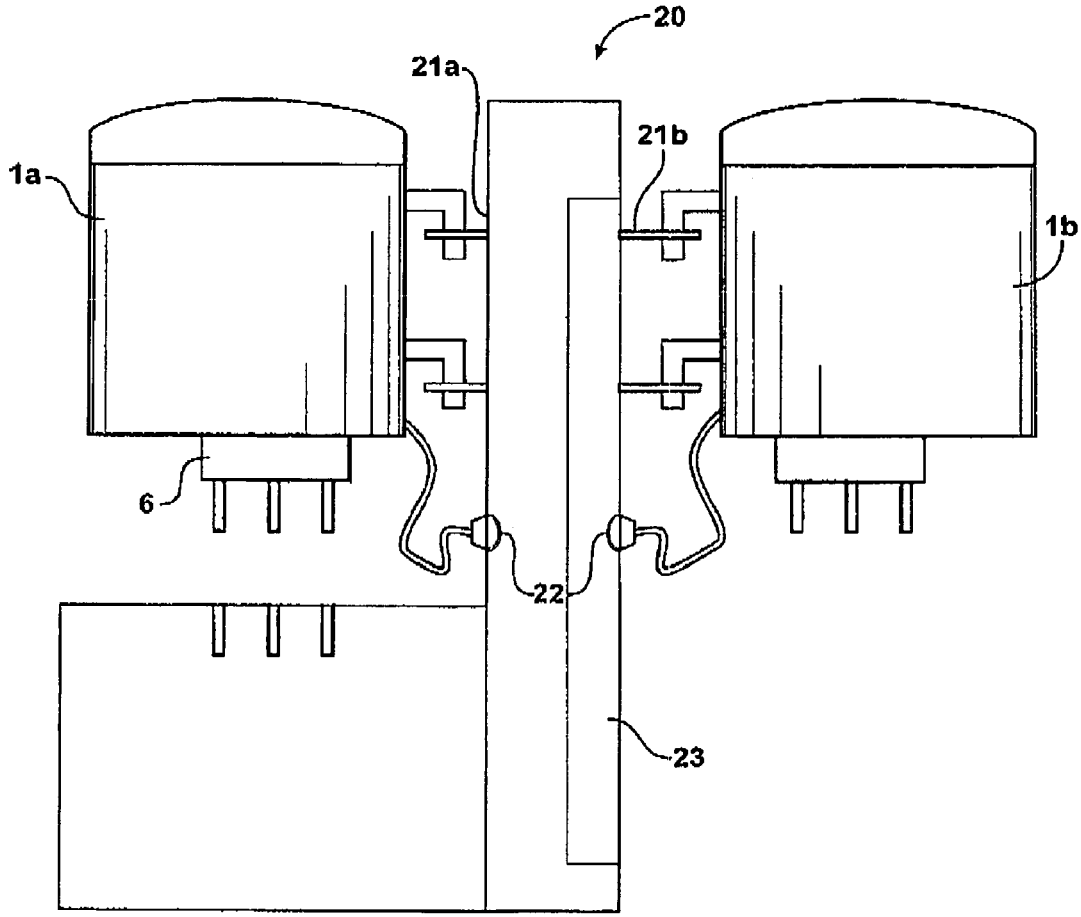
Figure 4:
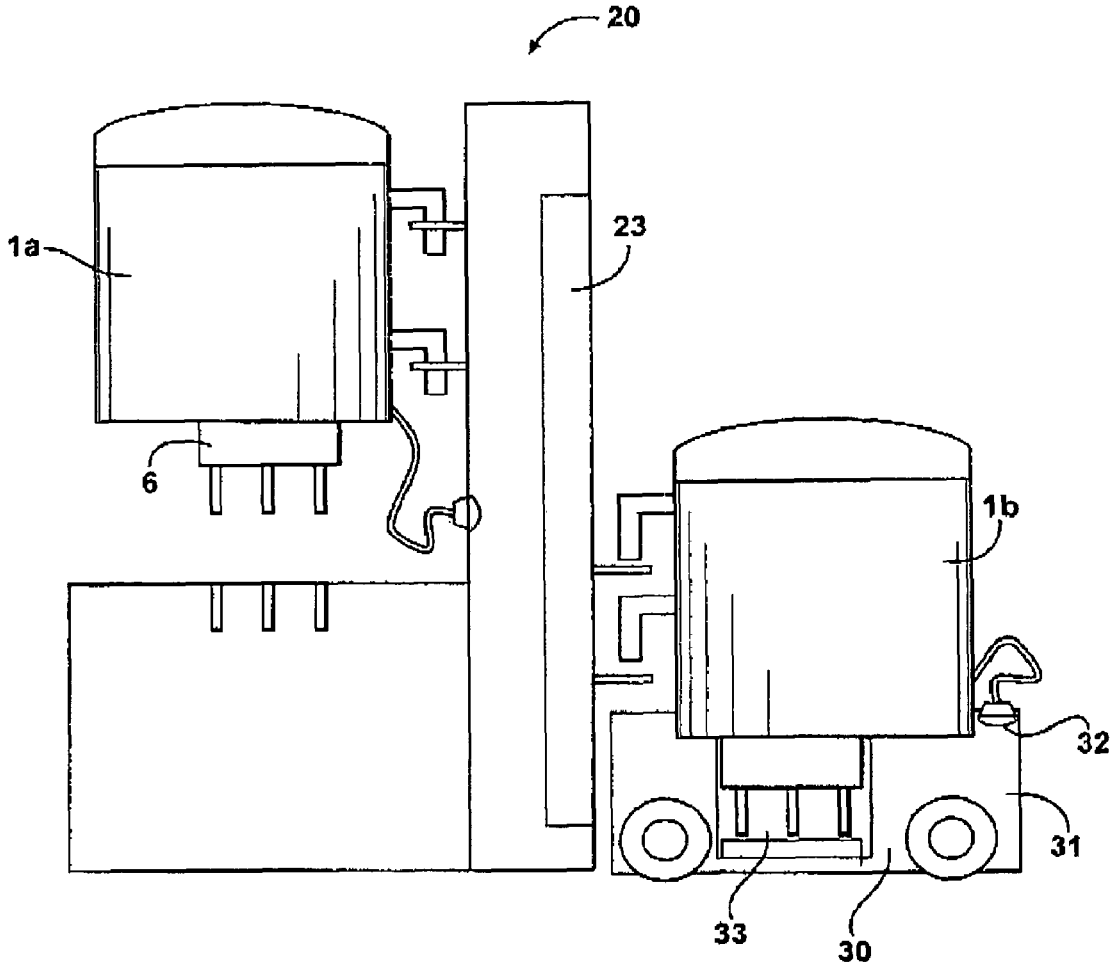

In the following exemplary embodiments of the invention are described by means of the attached drawings in which FIG. 1 shows a side view of the storing unit according to the invention, FIG. 2 shows a cross view through the embodiment of the storing unit according to the invention, FIG. 3 shows an embodiment of the molding apparatus according to the invention with two storing units, and FIG. 4 shows an embodiment of the transport carriage according to the invention.

FIG. 1 shows a side view of an embodiment of the storing unit 1 according to the invention. The storing unit 1 consists of housing 3 and dispensing means 6 located in the lower area of the housing 3. The dispensing means 6 comprises several openings 6*a*, 6*b*, 6*c* from which the materials to be molded can directly be filled into the corresponding molds. In addition, the molding unit 1 comprises attaching means 7. In the present embodiment this are several hooks 7*a*, 7*b* which can be hooked in corresponding openings in the attaching means 21 of the molding apparatus 20. The attaching means 7 can also be realized by other means. The storing unit 1 can for example be attached to the molding apparatus 20 by means of two cantilevers as they are used for examples by fork lifts. In the embodiment shown in FIG. 1 the storing unit 1 comprises also a contact 8 having the shape of a plug via which the storing unit 1, in particular the heating means 4 and the mixing means 5 can be provided with power.

FIG. 2 shows a cross view through the embodiment of the storing unit 1 according to the invention. In the housing 3 of the storing unit 1 there is a container 2. In this container 2 the materials to be molded are kept before they leave the storing unit 1 via the dispensing means 6. The materials are heated by heating means 4 located in the housing 3 of the storing unit 1. The placing of the heating means 4 in the housing 3 simplifies the cleaning of the storing unit 1, since thereby the heating coils of the heating means 4 do not come directly into contact with the materials to be molded. Alternatively the heating means 4 can also be placed in the container 2.

The container 2 comprises also mixing means 5 for mixing the materials to be molded in the container 2. The mixing means 5 is placed in the present embodiment close to the bottom of the container 2 in order to achieve an optimal as possible mixing function.

Within the present invention the storing unit 1 can also comprise additional features so that the storing unit 1 itself can also be used as a process boiler. In such a process boiler all or at least a part of the processes can be carried out which are necessary for providing the materials to the molding process. Examples for additional features are load cells for weighing the filled in materials and soaking means for soaking the materials.

FIG. 3 shows an embodiment of the molding apparatus 20 according to the invention in the form of a tower with two storing units 1*a*, 1*b* attached thereto. The molding apparatus 20 comprises therefore two attaching means 21*a*, 21*b*. Each of these attaching means 21*a*, 21*b* is designed in such a manner that the attaching means of the storing unit 1*a*, 1*b* can easily and quickly be received. In the present embodiment these are openings in which the hooks of the storing units 1*a*, 1*b* can be hooked in. The attaching means 21 can also be realized by other suitable means. The molding apparatus 20 comprises also for each storing unit 1 a contact 22 via which the storing unit can be provided with power.

In the situation shown in FIG. 3 one storing unit 1*a* is located in a so-called working position this means the openings of the dispensing means 6 are located above the molds to be filled in the molding apparatus 20. In this condition the heating means 4 and the mixing means 5 keep the materials to be molded in the right condition for the molding process. By means of suitable means the openings of the dispensing means 6, the so-called dose nozzles, are introduced into the molds during the filling process in order to fill them. The use of tubes as in the prior art is therefore not necessary.

In FIG. 3 a further storing unit 1*b* is shown in parallel at the second attaching means 21*b*. This storing unit 1*b* is located in the so-called waiting position. The storing unit 1*b* is not used for the molding process at this point in time. For example this can be a storing unit 1*b* which was already used for the molding process and which is now ready to be removed from the molding apparatus 20 to be cleaned and to be filled up again.

However, cleaning of the storing unit 1*b* need not always be necessary. If the new materials correspond to the preceding materials with respect to condition and color, a new block of the materials to be molded can also be directly filled in the storing unit 1*b*. This block is then made liquid by means of the heating means 4 and the mixing means 5 and can directly be used in the molding process.

The storing unit 1*b* shown in the waiting position can also be a storing unit 1*b* which is already cleaned and be filled with new materials. In this case the storing unit 1*b* was preferably cleaned from the remains of the previously used materials. In the laboratory the materials can be directly prepared in the storing unit 1*b* and by means of the heating means 4 and the mixing means 5 the new materials can be kept in the condition necessary for the molding process. Alternatively the new materials can also be filled in here in blocks into the molding unit 1*b* and then be made liquid with the heating means 4 and the mixing means 5.

When the storing unit 1*b* in the waiting position is filled with new materials to be molded, for example with a different color, the storing unit 1*b* can be used in order to carry out a color exchange in the molding apparatus 20 as soon as possible. As soon as the color should be exchanged, the two storing units 1*a*, 1*b* can exchange their position by means of a suitable mechanism. This can be a mechanism for example by which the two attaching means 21*a*, 21*b* of the molding apparatus 20 are pivotable placed around a pivotal point between the two attaching means 21*a*, 21*b*. For exchanging the position the two storing units 1*a*, 1*b* pivot then around this pivotal point. This process takes few seconds. As soon as the storing unit 1*b* with the new color is arrived in the working position, the new color can be used for the molding process. Further adjustment processes are not necessary.

In order to exchange the just used storing unit 1*a*, this storing unit 1*a* can be driven downwards by means of the transporting means 23 so that it can be placed for example on the transport carriage 30. Such a transport carriage 30 is exemplary shown in FIG. 4. This carriage 30 comprises several wheels and a platform. On this platform there is an attaching means 31 for the storing unit 1*a*. In this embodiment the attaching means 31 is different than the attaching means used at the molding apparatus 20. The transport carriage 30 has in this embodiment simply one opening in which the storing unit 1*a* can be placed.

In the embodiment shown in FIG. 4 the attaching means 7 of the storing unit 1 is formed in such a manner that the storing unit 1 can be placed on the transport carriage 30, the transport means 23 can be driven further downwards so that the attaching of the storing unit 1 to the molding apparatus 20 is released. This enables an exceptionally easy releasing of the relatively heavy storing unit 1 from the molding apparatus 20. The storing unit 1 can then be contacted to a power supply via a contact 32 of the transport carriage. By this the remains in the storing unit 1 can be kept liquid which substantially simplifies the subsequent necessary cleaning. The transport carriage 30 comprises also a unit 33 for receiving the dispensing means 6. This unit 33 can be used for example in order to let remains from the storing unit 1 already in the carriage run into a bin assigned to the unit 33 for receiving the dispensing unit 6. In addition on the transport carriage 30 there can be located one or more units with molds, in particular lipstick molds, in order to carry out sample fillings, in particular for quality tests, by means of the dispensing means 6.

Certainly, the transport carriage 30 can similarly be used in order to transport newly filled storing units 1 to the molding apparatus 20. The storing unit 1 is then raised at the molding apparatus 20 by the transport means 23 out of the transport carriage 30 and transported into the waiting position.

The invention claimed is:

1. A storing unit (1) for storing materials for a molding process for producing lipstick leads and being removably connectable to a molding apparatus (20); said storing unit (1) comprising:

a housing (3) defining a container (2) for keeping the materials to be molded;

heating means (4) of said housing (3) for heating up the materials to be molded;

mixing means (5) for mixing the heated-up materials in the container (2); and attaching means (7) for removably attaching said storing unit (1) to the molding apparatus (20).

2. A storing unit (1) as set forth in claim 1 further including dispensing means (6) for removing the heated up materials from said container (2).

3. A storing unit (1) as set forth in claim 1 further including at least one contact (8) for providing power to at least one of said heating means (4) and said mixing means (5).

4. A storing unit (1) as set forth in claim 1 wherein said housing (3) includes a lid (9).

5. A molding system for molding materials comprising;

a molding apparatus (20) for molding materials, at least one storing unit (1*a*, 1*b*) removably connected to said molding apparatus (20) for storing materials for a molding process, wherein said at least one storing unit (1*a*, 1*b*) comprises a housing (3) defining a container (2) for keeping the materials to be molded, heating means (4) of said housing (3) for heating up the materials to be molded, mixing means (5) for mixing the heated up materials in said container (2), and attaching means (7) for removably attaching said storing unit (1*a*, 1*b*) to the molding apparatus (20).

6. A molding system as set forth in claim 5 wherein said molding apparatus (20) includes at least one contact (22) connected to at least one of said storing units (1*a*, 1*b*) for providing power to said at least one of said storing units (1*a*, 1*b*).

7. A molding system as set forth in claim 5 wherein said molding apparatus (20) comprises attaching means (21) for removable attaching a storing unit (1*a*, 1*b*), wherein said attaching means (21) of said molding apparatus (20) is adjustable with respect to the height through transport means (23).

8. A molding system as set forth in claim 5 wherein said molding apparatus (20) includes at least two attaching means (21*a*, 21*b*) each for removable attaching to at least one of said storing unit (1*a*, 1*b*), respectively, for storing materials for a molding process.

9. A molding system as set forth in claim 5 wherein the at least one storing unit (1*a*, 1*b*) further includes dispensing means (6) for removing the heated-up materials from said container (2).

10. A storing unit (1) as set forth in claim 1 wherein said attaching means (7) includes hooks (7A, 7B).

11. A storing unit (1) as set forth in claim 1 wherein said attaching means (7) includes cantilevers.

12. A molding system as set forth in claim 5 wherein said attaching means (7) includes hooks (7A, 7B).

13. A molding system as set forth in claim 5 wherein said attaching means (7) includes cantilevers.

* * * * *